US008257114B2

(12) United States Patent
Wang et al.

(10) Patent No.: US 8,257,114 B2
(45) Date of Patent: Sep. 4, 2012

(54) VERTICAL ELECTRICAL CONNECTOR

(75) Inventors: Chen-Xi Wang, Kunshan (CN); Hong-Qiang Han, Kunshan (CN); Zi-Qiang Zhu, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 58 days.

(21) Appl. No.: 12/978,644

(22) Filed: Dec. 27, 2010

(65) Prior Publication Data

US 2011/0159733 A1 Jun. 30, 2011

(30) Foreign Application Priority Data

Dec. 26, 2009 (CN) ..... 2009 2 0318617

(51) Int. Cl.
*H01R 13/648* (2006.01)

(52) U.S. Cl. ..... 439/607.01

(58) Field of Classification Search ..... 439/607.01, 439/607.08, 660, 79, 64, 954
See application file for complete search history.

(56) References Cited

U.S. PATENT DOCUMENTS 7,303,410 B2 12/2007 Saito
7,845,961 B2 * 12/2010 Zhu et al. ..... 439/108
7,927,142 B2 * 4/2011 Wang et al. ..... 439/607.04
8,033,868 B2 * 10/2011 Wang et al. ..... 439/660
8,142,209 B2 * 3/2012 Zhu et al. ..... 439/108
2010/0227504 A1 * 9/2010 Wang et al. ..... 439/607.41
2011/0159733 A1 * 6/2011 Wang et al. ..... 439/607.01
2011/0312200 A1 * 12/2011 Wang et al. ..... 439/218
2011/0312223 A1 * 12/2011 Wang et al. ..... 439/626

* cited by examiner

*Primary Examiner* — Tulsidas C Patel
*Assistant Examiner* — Phuongchi Nguyen
(74) *Attorney, Agent, or Firm* — Wei Te Chung; Andrew C. Cheng; Ming Chieh Chang

(57) ABSTRACT

An electrical connector (100) includes an insulative housing (1), a set of contacts (2) retained in the insulative housing and a metal shell (3) covering the insulative housing. The insulative housing includes a base (11) and a tongue plate (12) protruding upwardly. The contacts have contacting portions (21) arranged in one row, retaining portions (22) extending from lower ends of the contacting portions and retained in the base, and tail portions (23) bending forwardly from lower ends of the retaining portions for being mounted directly onto a surface of the printed circuit board. The metal shell includes a front wall (31), a back wall (32) opposite to the front wall, and a pair of side walls (33) connecting the front and back walls. The front wall has a depressed wall (310) depressed backwardly and forming a hollow space for the tail portions (23) forwardly extending into.

10 Claims, 5 Drawing Sheets

VERTICAL ELECTRICAL CONNECTOR

BACKGROUND OF THE INVENTION

1. Field of the Invention

The present invention relates to electrical connectors, and more particularly to a vertical type electrical connector.

2. Description of Related Art

Electrical connectors present as a medium being widely used in computers and other electronic device for electrically connecting the electronic device with each other to transmit signals. A common electrical connector usually includes an insulative housing, a plurality of contacts retained in the insulative housing for transmitting signals, and a metal shell covering the insulative housing for shielding the electrical connector from being disturbed.

Various electrical connectors are designed by electronic companies for being used in different or same electronic devices. Of course, there will be many similar electrical connectors being designed, which is easily mismatched by consumers. When different electrical connectors are mismatched with each other, the electronic devices will transmit unmatchable signals to each other, which easily destroy the electronic devices.

Hence, an improved electrical connector is desired to overcome the above problems.

BRIEF SUMMARY OF THE INVENTION

According to one aspect of the present invention, an electrical connector for being mounted onto and orthogonal to a printed circuit board comprises an insulative housing including a base and a tongue plate protruding upwardly beyond an upper face of the base; a plurality of contacts having contacting portions arranged in one row along one side of the tongue plate, retaining portions extending from lower ends of the contacting portions and retained in the base, and tail portions bending forwardly from lower ends of the retaining portions for being mounted directly onto a surface of the printed circuit board; and a metal shell covering the insulative housing and including a front wall, a back wall opposite to the front wall, and a pair of side walls connecting the front and back walls. The front wall has a depressed wall depressed backwardly and forming a hollow space for the tail portions forwardly extending into.

According to another aspect of the present invention, an vertical electrical connector for being mounted onto a surface of a printed circuit board comprises an insulative housing including a base defining a recess recessed backwardly from a front face thereof and a tongue plate protruding upwardly from and beyond an upper face of the base; a plurality of contacts arranged in one row and including contacting portions arranged in a front face of the tongue plate, retaining portions extending from lower ends of the contacting portions and retained in the base, and tail portions bending forwardly from lower ends of the retaining portions for being mounted onto the surface of the printed circuit board; and a metal shell covering the insulative housing and including a front wall, a back wall opposite to the front wall, and a pair of side walls connecting the front and back walls, the front wall having a depressed wall depressed backwardly therefrom and received in the recess. The base has a plurality of protrusions protruding downwardly from a lower face opposite to the upper face and located between the depressed wall and the tongue plate in a front-to-back direction. The tail portions are retained in retaining slots formed between each two adjacent protrusions respectively and extend forwardly over the depressed wall.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
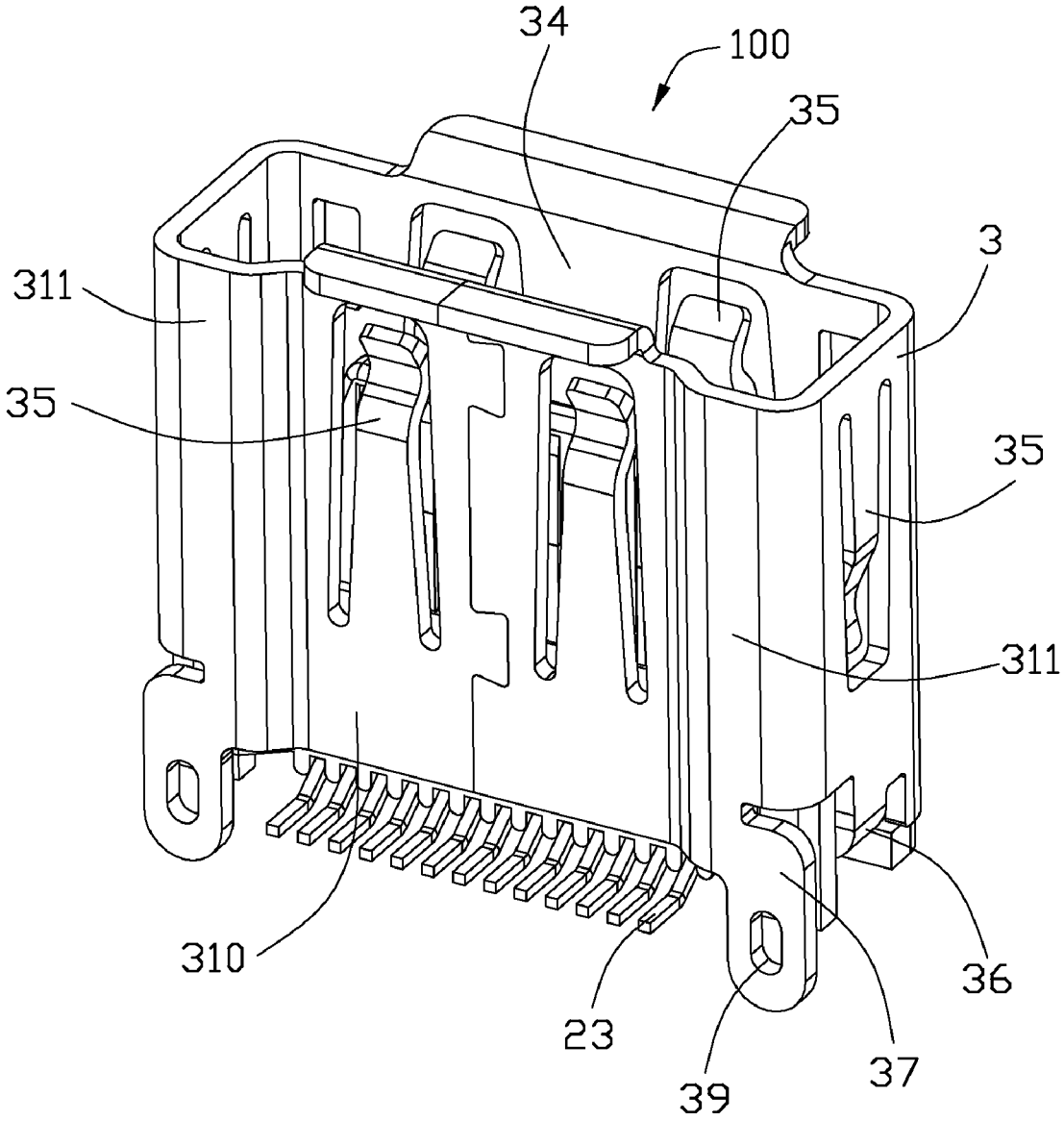
FIG. 1 is a perspective view of an electrical connector according to the present invention.
Figure 2:
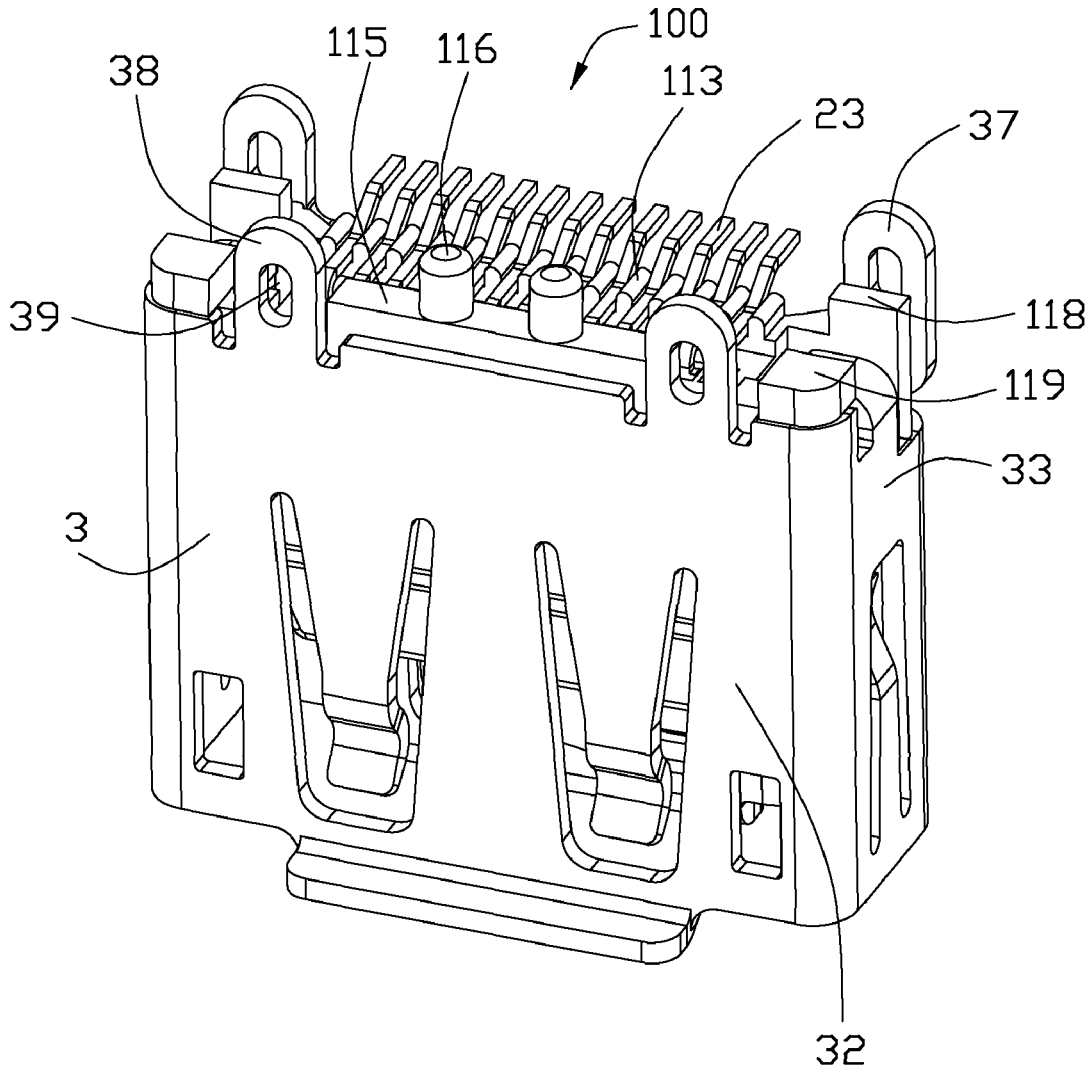
FIG. 2 is a view similar to FIG. 1, while taken from another aspect.
Figure 3:
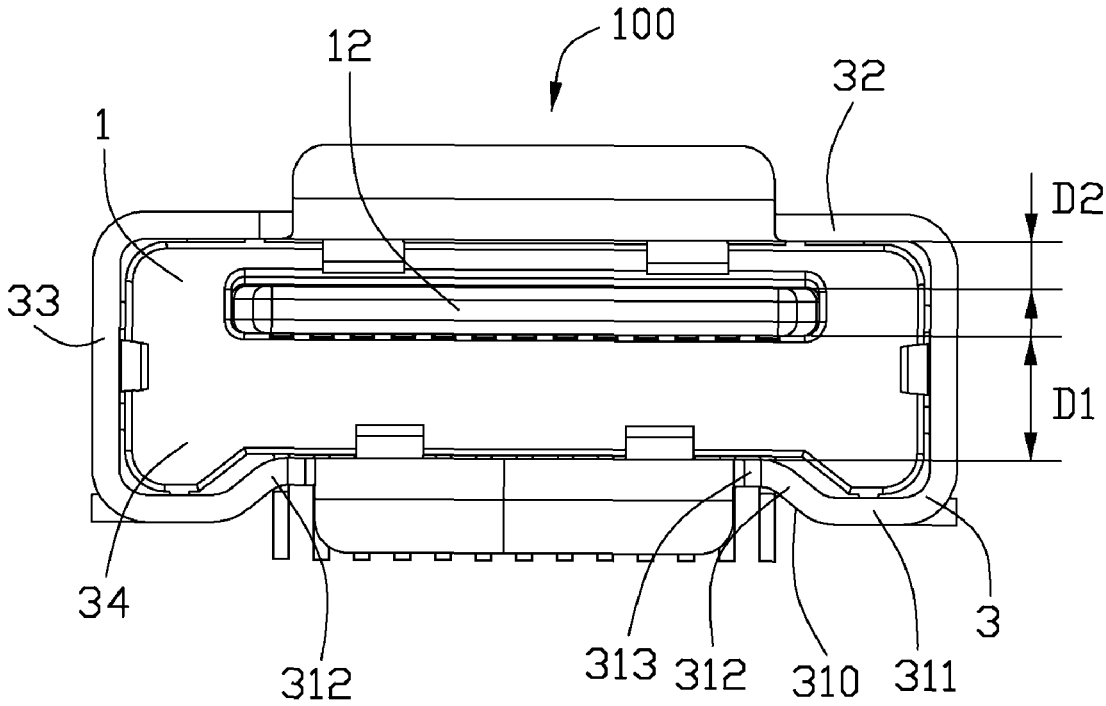
FIG. 3 is a top plan view of the electrical connector shown in FIG. 1.
Figure 4:
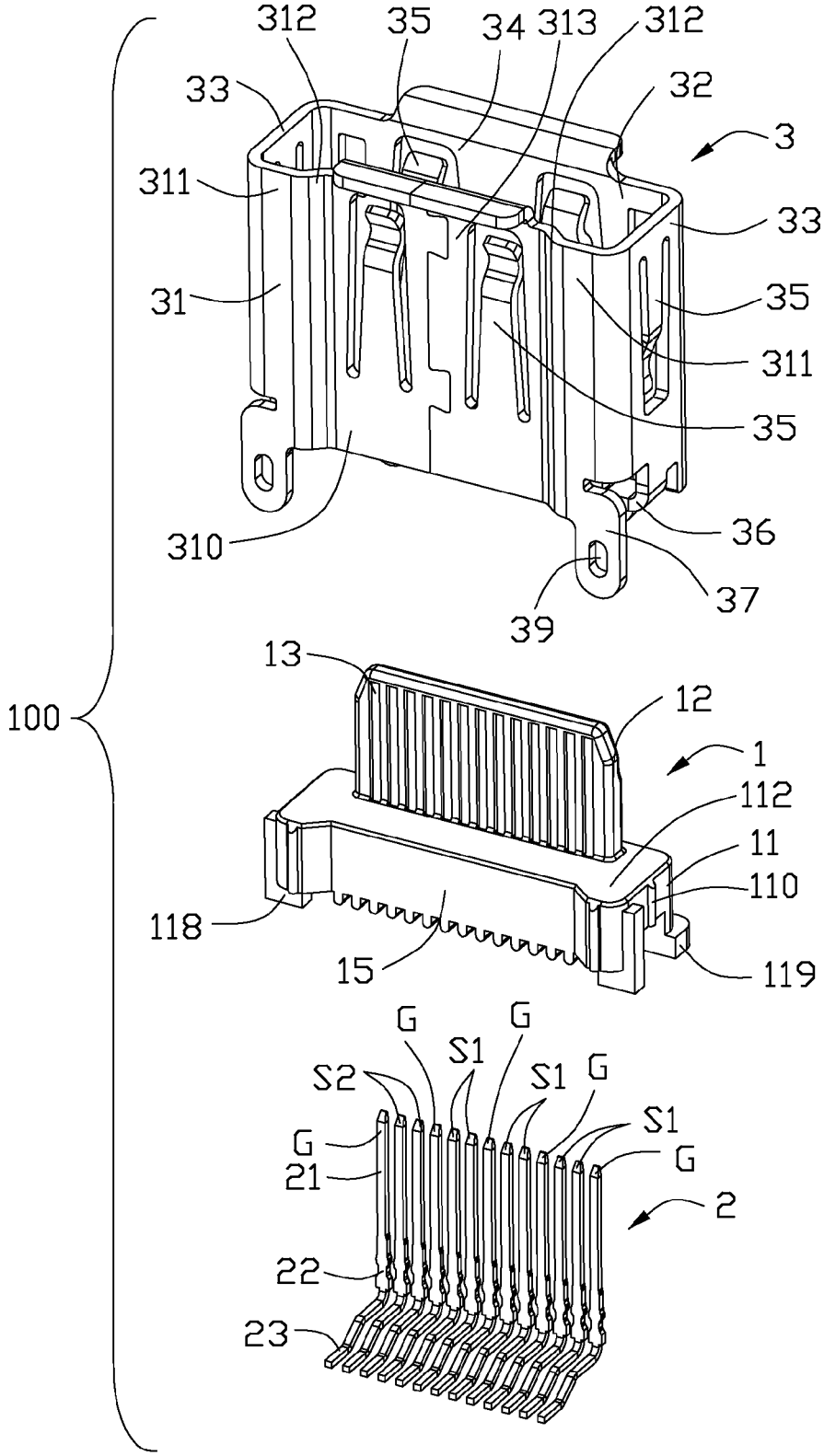
FIG. 4 is an exploded view of the electrical connector shown in FIG. 1.
Figure 5:
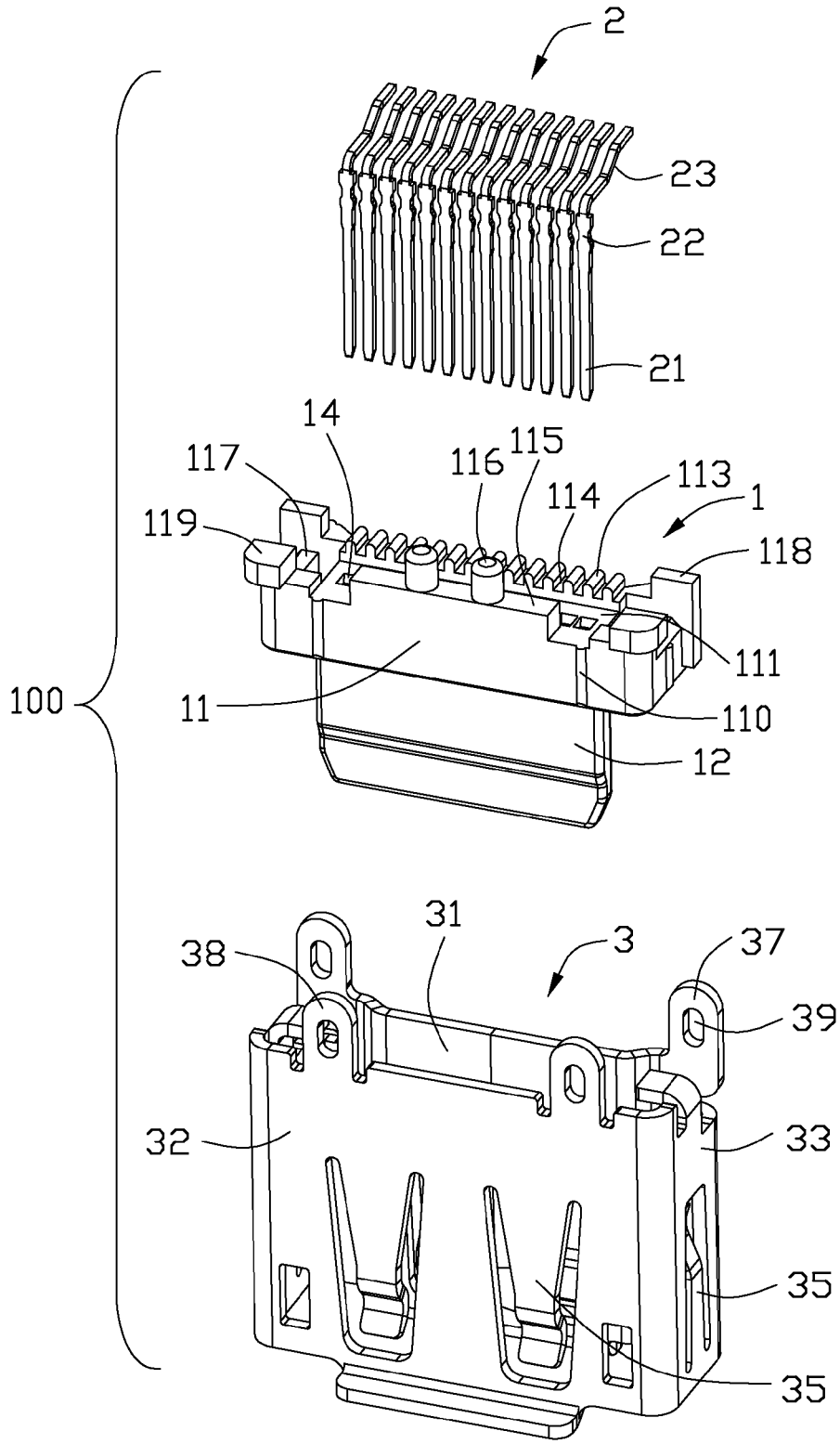
FIG. 5 is a view similar to FIG. 4, while taken from another aspect.

Referring to FIGS. 4 and 5, a vertical electrical connector 100 according to the present invention for being mounted to a printed circuit board (PCB hereinafter, not shown) is disclosed. The electrical connector 100 is orthogonal to the PCB and includes an insulative housing 1, a plurality of contacts 2 retained in the insulative housing 1, and a metal shell 3 covering the insulative housing 1 and defining a receiving space 34 for receiving a matchable plug (not shown) which mates with the electrical connector 100.

Continue referring to FIGS. 4 and 5, the insulative housing 1 being molded of dielectric material such as plastic or the like, has a base 11 and a tongue plate 12 extending upwardly from an upper face 112 of the base 11 into the receiving space 34. The base 11 has a lower face 111 opposite to the upper face 112 and a plurality of retaining cavities 14 passing through the upper and lower faces 112, 111 along an upper-to-lower direction. The base 11 has a plurality of protrusions 113 protruding downwardly from the lower face 111, and defines a plurality of retaining slots 114 exposed to exterior and located between each two adjacent protrusions 113. A standoff 115 protrudes downwardly from the lower face 111 to resist the PCB and defines a pair of posts 116 protruding downwardly therefrom to be retained in holes of the PCB, therefore, the insulative housing 1 could be retained in the PCB reliably. The base 11 has a pair of projections 118 projecting downwardly from the lower face 111 and located at two lateral sides of the protrusions 113, a pair of stoppers 119 formed on the lower face 111 and expanding outwardly beyond the base 111 to resist the metal shell 3 upwardly, and a pair of locking portions 117 located between the corresponding projections 118 and stoppers 119. Bottom faces of the standoff 115, the projections 118 and the stoppers 119 are coplanar in a plane so as to be seated on the PCB reliably. The base 111 has a recess 15 recessed backwardly from a front face thereof, and a plurality of ribs 110 are formed on the front face, a back face opposite to the front face, and two lateral sides of the base 11 so as to compensate tolerances between the base 11 and the metal shell 3. The tongue plate 12 has a set of passageways 13 arranged in a front face thereof and communicating with the retaining cavities 14 for receiving the contacts 2 respectively. In this embodiment, the tongue plate 12 is integrally formed with the base 11. It is also to be understood that, in other embodiments, the tongue plate 12 and the base 11 can be molded of dielectric material respectively and assembled together to form the insulative housing 1.

Referring to FIGS. 1 to 5, the contacts 2 each having a same shape are arranged in one row along a transverse direction and consist of a first type of grounding contacts G and a second type of a plurality of differential contacts S1, S2. The grounding contacts G comprise five grounding contacts G. The differential contacts S1, S2 comprise three pairs of first differential contacts S1 for unidirectionally transmitting data and a pair of second differential contacts S2 for bi-directionally transmitting hybrid data. Each pair of differential contacts S1, S2 include a + data contact and a – data contact. Each pair of differential contacts S1, S2 arranged between each two adjacent grounding contacts G. Therefore, the interference between each two adjacent pair of the differential contacts can be reduced. The pair of second differential contacts S2 are arranged at one side of the pairs of first differential contacts S1. The four pairs of differential contacts S1, S2 enable the electrical connector 100 to supply a wider transmission bandwidth and increase data transmission speed. The pair of second differential contacts S2 enable the electrical connector 100 to bi-directionally transmit a high-speed hybrid data. In this embodiment, the contacts 2 are arranged in the following sequence: grounding contact G, a pair of first differential contacts S1, grounding contact G, a pair of first differential contacts S1, grounding contact G, a pair of first differential contacts S1, grounding contact G, a pair of second differential contacts S2, and grounding contact G. The contacts 2 having five grounding contacts G and four pair of differential contacts consist of only two types in function, the chipset designed for the connector 100 will be simplified. Furthermore, the fewer amount of the contacts 2 can miniature the electrical connector 100. In other embodiments of the present invention, the three pairs of first differential contacts S1 which unidirectionally transmit data and three grounding contacts G are arranged alternatively, and one pair of first differential contacts S1 are arranged at outside, a pair of grounding contacts G are arranged between the pair of first differential contacts S1 and the pair of second differential contacts S2 which bi-directionally transmit hybrid data, the pair of second differential contacts S2 are located in an outermost side of the contacts 2, in this embodiment, the contacts 2 are arranged in the following sequence: grounding contact G, a pair of first differential contacts S1, grounding contact G, a pair of first differential contacts S1, grounding contact G, a pair of first differential contacts S1, grounding contact G, grounding contact G, and a pair of second differential contacts S2. The space between the pair of first and the pair of second differential contacts S1, S2 can be increased, the interference between the pair of first and the pair of second differential contacts S1, S2 can be reduced more effectively.

Referring to FIGS. 1-5, each contact 2 has a retaining portion 22 retained in the corresponding retaining cavity 14 of the base 11, a flat contacting portion 21 extending upwardly from an upper end of the retaining portion 22 and received in the corresponding passageway 13, and a tail portion 23 bending forwardly form a lower end of the retaining portion 22 and retained in the corresponding retaining slot 114 so as to be soldered directly onto a surface of the PCB reliably. The contacting portions 21 are exposed to the receiving space 34 to electrically mate with the matchable plug. All of the contacting portions 21 are arranged in one row and received in the passageways 14 on the front face of the tongue plate 12 so as to decrease thickness of the tongue plate 12 in a front-to-back direction.

In this embodiment, the contacts 2 are stamped from a contact carrier (not shown) and assembled to the insulative housing 1. In other embodiments, the contact 2 can be integrally molded into the insulative housing 1. Furthermore, the tongue plate 12 can be replaced by a sub printed circuit board, and gold fingers on the sub printed circuit board will replace the contacting portion 21 to electrically mate with the matchable plug.

The metal shell 3 is made of a piece of metallic sheet and includes a front wall 31, a flat back wall 32 opposite to the front wall 31, and a pair of side walls 33 connecting the front and back walls 31, 32. The receiving space 34 is surrounded by the front wall 31, the back wall 32, and the side walls 33. The front wall 31 includes a depressed wall 310 depressed backwardly therefrom, and a pair of connecting walls 311 extending in curve planes and bowed forwardly. The connecting walls 311 connect the depressed wall 310 and the side walls 33. The depressed wall 310 is received in the recess 15 so that the metal shell 3 could be retained in the base 11 along the transverse direction. The depressed wall 310 includes a pair of engaging walls 313 defining dovetail slots and dovetail blocks (not labeled) for mating with each other, and a pair of inclined walls 312 connecting the engaging walls 313 and the connecting walls 311. The engaging walls 313 and the inclined walls 312 form an isosceles trapezoid without a base. Therefore, the front wall 31 can be strengthened and form a good anti-mismating mechanism to prevent the unmatchable plug from being inserted into the receiving space 34. A distance formed between the connecting walls 311 and the back wall 32 is greater than a distance formed between the engaging walls 313 and the back wall 32. A first space D1 measured between the engaging walls 313 and a front face of the tongue plate 12 is almost twice a second space D2 measured between the back wall 32 and a back face of the tongue plate 12. The second space D2 is measured for retaining a top wall formed on a metal shell of the matchable plug so as to prevent the unmatchable plug from being inserted into the receiving space 34.

A set of resilient tangs 35 unitarily extend from the front wall 31, the back wall 32, and the side walls 33 and are adapted to be outwardly deflected once the matchable plug is inserted into the receiving space 34. Each side wall 33 has a latching barb 36 extending from a lower edge thereof to latch on the corresponding locking portion 117 so that the metal shell 3 could be retained on the insulative housing 1 firmly. The front wall 31 has a pair of first legs 37 extending downwardly from the connecting walls 311 for being mounted onto the PCB. The back wall 32 has a pair of second legs 38 extending downwardly from a lower edge thereof for being mounted onto the PCB and positioned interior of the first legs 37. The first and second legs 37, 38 form an isosceles trapezoid so that the electrical connector 100 could be retained on the PCB firmly. The first and second legs 37, 38 have apertures 39 passing therethrough so as to be soldered onto the PCB reliably.

Referring to FIGS. 1-5, all of the tail portions 23 extend outwardly over the engaging walls 313 and are mounted onto a surface of the PCB. The depressed walls 310 of the front wall 31 are depressed backwardly to form a hollow space for the tail portions 23 extending into. Therefore, the dimension of the electrical connector 100 in the front-to-back direction could be decreased under a condition that the tail portions 23 have predetermined lengths. As the first space D1 measured between the engaging walls 313 and the front face of the tongue plate 12 is larger than the second space D2 measured between the back wall 32 and the back face of the tongue plate 12, the lower face 111 of the insulative housing 1 offers more space between the engaging walls 313 and the front face of the tongue plate 12 for the protrusions 113 extending along so that the protrusions 113 could retain the tail portions 23 firmly.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector for being mounted onto and orthogonal to a printed circuit board comprising:

an insulative housing including a base and a tongue plate protruding from and upwardly beyond an upper face of the base;

a plurality of contacts having contacting portions arranged in one row along one side of the tongue plate, retaining portions extending from lower ends of the contacting portions and retained in the base, and tail portions bending forwardly from lower ends of the retaining portions for being mounted directly onto a surface of the printed circuit board; and a metal shell covering the insulative housing and including a front wall, a back wall opposite to the front wall, and a pair of side walls connecting the front and back walls, the front wall having a depressed wall depressed backwardly and forming a hollow space for the tail portions forwardly extending thereinto for inspection purpose; wherein the base has a plurality of protrusions protruding downwardly from a lower face opposite to the upper face and facing the printed circuit board, and forms a plurality of retaining slots exposed to exterior and located between each two adjacent protrusions for retaining the tail portions respectively; wherein the base has a set of stoppers formed on the lower face of the base and expanding outwardly beyond the base for upwardly resisting the metal shell and downwardly standing on the printed circuit board; wherein wherein the first and second legs form an isosceles trapezoid in condition that the second legs are located at interior of the first legs; wherein the depressed wall includes a pair of engaging walls defining dovetail slots and dovetail blocks for mating with each other, and a pair of inclined walls connecting the engaging walls and the connecting walls, all of the tail portions extend forwardly over the engaging wall, a first space measured between the engaging walls and the tongue plate is greater than a second space measured between the back wall and tongue plate; wherein the contacts comprise a grounding contact, a pair of first differential contacts for unidirectionally transmitting data, two grounding contacts, and a pair of second differential contacts for bi-directionally transmitting hybrid data arranged in sequence along a transverse direction of the electrical connector.

2. The electrical connector according to claim 1, wherein the base has a standoff located between two stoppers and a pair of posts protruding downwardly from the standoff for being retained in holes of the printed circuit board.

3. The electrical connector according to claim 1, wherein the front wall has a pair of connecting walls connecting the depressed wall and the side walls, the metal shell has a pair of first legs extending downwardly from the connecting walls for being mounted onto the printed circuit board and a pair of second legs extending downwardly from the back wall for being mounted onto the printed circuit board.

4. The electrical connector according to claim 1, wherein the metal shell has a set of resilient tangs unitarily formed on the engaging walls, the back wall, and the side walls.

5. An vertical electrical connector for being mounted onto a surface of a printed circuit board comprising:

an insulative housing including a base defining a recess recessed backwardly from a front face thereof and a tongue plate protruding upwardly beyond an upper face of the base;

a plurality of contacts arranged in one row and including contacting portions arranged in a front face of the tongue plate, retaining portions extending from lower ends of the contacting portions and retained in the base, and tail portions bending forwardly from lower ends of the retaining portions for being mounted onto the surface of the printed circuit board; and a metal shell covering the insulative housing and including a front wall, a back wall opposite to the front wall, and a pair of side walls connecting the front and back walls, the front wall having a depressed wall depressed backwardly therefrom and received in the recess; wherein the base has a plurality of protrusions protruding downwardly from a lower face opposite to the upper face and located between the depressed wall and the tongue plate in a front-to-back direction, the tail portions are retained in retaining slots formed between each two adjacent protrusions respectively and extend forwardly over the depressed wall; wherein a first distance measured between the first legs are greater than a second distance measure between the second legs; wherein the depressed wall includes a pair of engaging walls defining dovetail slots and dovetail blocks for mating with each other, and a pair of inclined walls connecting the engaging walls and the connecting walls, a first space measured between the engaging walls and the tongue plate is greater than a second space measured between the back wall and tongue plate; wherein the contacts comprise a grounding contact, a pair of first differential contacts for unidirectionally transmitting data, two grounding contacts, and a pair of second differential contacts for bi-directionally transmitting hybrid data arranged in sequence along a transverse direction of the electrical connector.

6. The vertical electrical connector according to claim 5, wherein the front wall has a pair of connecting walls connecting the depressed wall and the side walls, the metal shell has a pair of first legs extending downwardly from the connecting walls for being mounted onto the printed circuit board and a pair of second legs extending downwardly from the back wall for being mounted onto the printed circuit board.

7. A vertical electrical connector comprising:

an insulative housing defining a horizontal base with a mating tongue vertically extending from an upper face of the base;

a recess formed in a side face of said base;

a plurality of passageways formed in the base and the mating tongue;

a plurality of contacts disposed in the corresponding passageways, respectively; and a metallic shell including opposite first and second longitudinal side walls along a longitudinal direction, and opposite first and second lateral side walls along a lateral direction to commonly surround the housing under condition that the first longitudinal side wall defines a depressed wall received in the recess; wherein the first longitudinal side wall defines a first pair of mounting legs extending downwardly from a bottom portion thereof and essentially located by two sides of the depressed wall and intimately close to the corresponding first and second lateral side walls along the longitudinal direction, respectively, while the second longitudinal side wall defines a second pair of mounting legs relatively farther from the corresponding first and second lateral side walls in the longitudinal direction than said first pair of mounting legs, respectively; wherein the base further includes a pair of stopper blocks at two opposite longitudinal ends in said longitudinal direction so as to abut against a bottom edge of the shell; wherein the base further include at least one post unitarily extending downwardly from a bottom face thereof and located between the pair of stopper blocks in the longitudinal direction; wherein the depressed wall includes a pair of engaging walls defining dovetail slots and dovetail blocks for mating with each other, and a pair of inclined walls connecting the engaging walls and the connecting walls, all of the tail portions extend forwardly over the engaging wall, a first space measured between the engaging walls and the tongue plate is greater than a second space measured between the back wall and tongue plate; wherein the contacts comprise a grounding contact, a pair of first differential contacts for unidirectionally transmitting data, two grounding contacts, and a pair of second differential contacts for bi-directionally transmitting hybrid data arranged in sequence along a transverse direction of the electrical connector.

8. The vertical electrical connector as claimed in claim 7, wherein the lateral side walls defines a pair of latching barbs upwardly abutting against a bottom face of the base around the corresponding stopper blocks, respectively.

9. The vertical electrical connector as claimed in claim 7, wherein each of said contacts includes a vertically extending contacting section exposed upon the mating tongue and a laterally extending tail received in corresponding retaining slots formed in a bottom face of the base under condition that said laterally extending tail is exposed to an exterior beside said depressed wall in a top view.

10. The vertical electrical connector as claimed in claim 9, wherein said laterally extending tails are located between said first pair of mounting legs.

* * * * *